United States Patent [19]

Aoki et al.

[11] Patent Number: 4,929,161

[45] Date of Patent: May 29, 1990

[54] AIR-COOLED OIL-FREE ROTARY-TYPE COMPRESSOR

[75] Inventors: Masakazu Aoki; Akira Suzuki, both of Shimizu, Japan

[73] Assignee: Hitachi, Ltd., Tokyo, Japan

[21] Appl. No.: 260,774

[22] Filed: Oct. 21, 1988

[30] Foreign Application Priority Data

Oct. 28, 1987 [JP] Japan ..... 62-270452
Mar. 30, 1988 [JP] Japan ..... 63-74342

[51] Int. Cl.[5] ..... F04C 29/02; F04C 29/04

[52] U.S. Cl. ..... 418/83; 418/85; 418/101

[58] Field of Search ..... 418/83, 85, 101, 270, 418/86; 165/111, 113, 176

[56] References Cited

U.S. PATENT DOCUMENTS 1,730,145 10/1929 Hildreth ..... 418/101
1,780,337 11/1930 Canton ..... 418/101
2,612,350 9/1952 Stadler ..... 165/176
3,008,631 11/1961 Paugh ..... 418/101
4,529,363 7/1985 Suzuki ..... 418/83
4,725,210 2/1988 Suzuki et al. ..... 418/83
4,770,240 9/1988 Dawson et al. ..... 165/176

FOREIGN PATENT DOCUMENTS 4822508 9/1929 Fed. Rep. of Germany .
60-85286 5/1985 Japan ..... 418/83
62-85194 4/1987 Japan .
62-186093 8/1987 Japan .

*Primary Examiner*—John J. Vrablik
*Attorney, Agent, or Firm*—Antonelli, Terry, Stout & Kraus

[57] ABSTRACT

An air-cooled oil-free rotary-type compressor comprises a first air cooling-type air cooler, a backflow preventing valve and a second air cooling-type air cooler respectively disposed in a channel of a discharge gas compressed in a compressor body. The first air cooling-type air cooler and the second air cooling-type air cooler are disposed in a passage of cooling air flow.

21 Claims, 5 Drawing Sheets

AIR-COOLED OIL-FREE ROTARY-TYPE COMPRESSOR

BACKGROUND OF THE INVENION

The present invention relates to an air-cooled oil-free rotary-type compressor and, more particularly, to an air-cooled oil-free rotary-type compressor having a compact cooling system.

In, for instance, U.S. Pat. No. 4,725,210, an oilless rotary-type compressor system is proposed which includes, inter alia, an oilless rotary compressor, a precooler and an after cooler for compressed air, a check valve, a jacket, a coolant cooler, a coolant pump, a transmission mechanism, an oil pump, an oil cooler and a cooling fan. In this conventional compressor system, the precooler is a liquid-cooled cooler which cools compressed air delivered from the compressor by using a cooling liquid (hereafter referred to as a coolant). By using cooling air from a cooling fan, the coolant cools the compressor coolant which cools a compressor body by circulating through the jacket and the coolant circulating through the precooler.

A disadvantage of the above-described rotary-type compressor system resides in that compressed air delivered from the compressor is cooled by the precooler which is a liquid-cooled cooler, and the coolant which has been subjected to heat exchange by this precooler and the jacket of the compressor is cooled by the coolant cooler which is an air-cooled cooler. Therefore, the coolant warmed to 60°–80° C. or thereabout is supplied to the coolant cooler, and a temperature difference with the cooling wind of about 20°–40° C. which in a cooling medium is small, so that it has been necessary to use a large-capacity coolant cooler. A large coolant cooler results in increasing the price of the compressor and constitutes a factor hindering a reduction in the size of the compressor.

SUMMARY OF THE INVENTION

Accordingly, an object of the present invention is to provide an air-cooled oil-free rotary-type compressor having a compact cooling system.

Another object of the present invention is to provide an air-cooled oil-free rotary-type compressor whose size is substantially equivalent to that of a water-cooled type even in the case of a large-capacity compressor.

To these ends, an air-cooled oil-free rotary-type compressor is provided which comprises a first air cooling-type air cooler; back-flow preventing means; and a second air cooling-type air cooler, wherein the first air cooling-type air cooler, the back-flow preventing means and the second air cooling-type air cooler are respectively disposed in a channel of a discharge gas compressed in a compressor body.

In accordance with one aspect of the present invention, there is provided an air-cooled oil-free rotary-type compressor comprising; a coolant cooler for cooling a coolant subjected to heat exchange in a jacket of a compressor body, with an oil cooler for cooling a lubricating oil subjected to heat exchange in a lubricated portion of the compressor and a cooling fan. A first air cooling-type air cooler; a back-flow preventing valve; and a a second air cooling-type air cooler are provided, the first air cooling-type air cooler, back-flow preventing valve and the second air cooling-type air cooling being disposed in a passage of a discharge gas compressed inside the compressor body. At least the coolant cooler, the oil cooler, the first air cooling-type air cooler and the second air-cooled cooler are disposed in the passage of an air flow passing through the cooling fan.

In accordance with another aspect of the present invention, an air-cooled oil-free rotary-type compressor comprises an oil cooler for cooling oil subjected to heat exchange in the compressor, a cooling fan, a first air cooling-type air cooler provided in a channel of a discharge gas compressed in a compressor body, back-flow preventing means, and a second air cooling-type air cooler. At least the oil cooler, the first air cooling-type air cooler and the second air cooling-type air cooler are disposed in a passage of an air flow passing through the cooling fan.

In accordance with still another aspect of the present invention, a compressor comprises a heat exchanger connected to a discharge port of a compressor body and adapted to primarily cool the high-temperature air discharged from the compressor body, with the heat exchanger having an inlet portion header, an outlet portion header and plurality of U-shaped cooling pipes each having an end portion of each being respectively secured to the headers.

DESCRIPTION OF THE PREFERRED EMBODIMENTS

Figure 1:
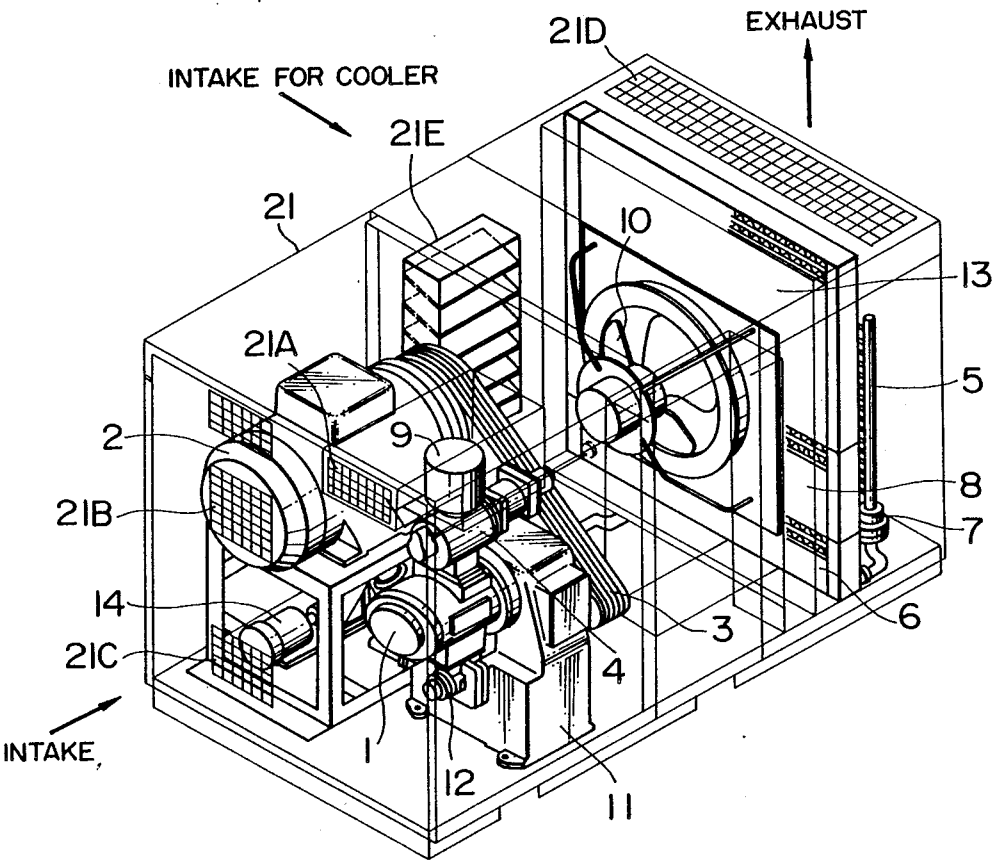
FIG. 1 is a schematic perspective view of an air-cooled oil-free rotary-type compressor in accordance with a first embodiment of the present invention.
Figure 2:
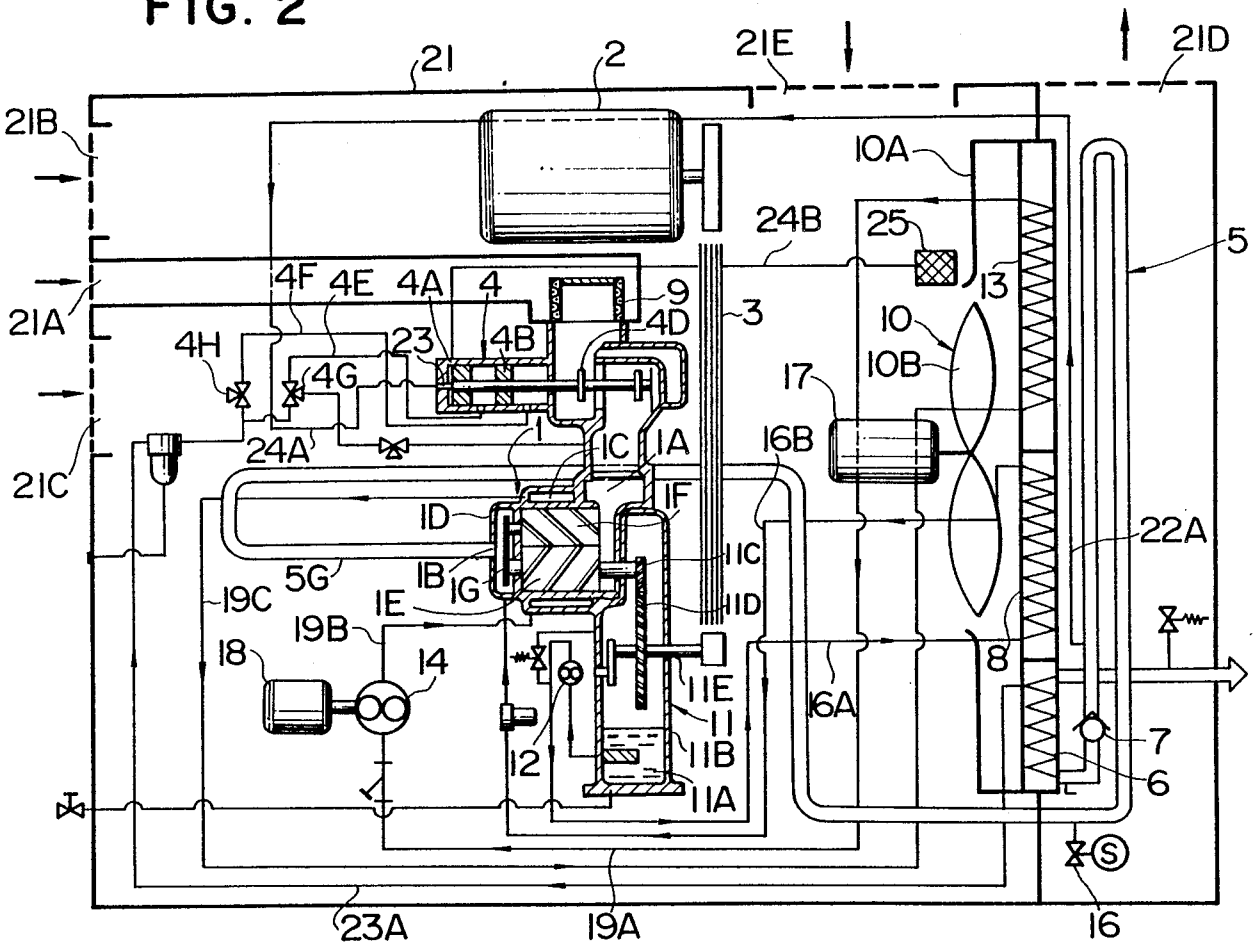
FIG. 2 is a schematic diagram of the compressor shown in FIG. 1.

Referring now to FIGS. 1 and 2, an air-cooled oil-free rotary-type compressor in accordance with the present invention comprises a compressor body 1, a main motor 2, a V-belt 3, a suction-blocking valve 4, a precooler 5 for compressed air, an after cooler 6 for compressed air, a check valve 7, and oil cooler 8, an air filter 9, a cooling fan 10, a transmission mechanism 11, an oil pump 12, a coolant cooler 13 and a coolant pump 14.

The structural features of the compressor body 1, the after cooler 6 and the transmission mechanism 11 may be of the type disclosed in, for example, U.S. Pat. No. 4,529,363.

As shown in FIG. 2, the compressor body 1 includes a casing 1D having a suction port 1A, a discharge port 1B and a jacket 1C, with a male rotor 1E and a female rotor 1F disposed in the casing 1D in such a manner so as to rotatably engage each other, and with a timing gear 1G connected to the bearing of the male and female rotors 1E, 1F. The suction-blocking valve 4 includes a cylinder 4A, a piston 4B slidably contained in the cylinder 4A, a valve 4D connected to the piston 4B and disposed in the air intake passage of the compressor body 1, pipes 4E, 4F, through which air is supplied to and discharged from the cylinder 4A to move the piston 4B and solenoid valves 4G, 4H. The solenoid valves 4G, 4H are connected to a piping 23A branched off from the after cooler 6 to supply compressed air.

The capacity control of the compressor is effected by restricting the amount of air flowing into the compressor by opening and closing the valve 4D through movement of the piston 4B. In addition, when the valve 4D is closed, the pressure on the discharge side of the compressor is released to the atmosphere by opening an air release valve 23, which operates in interlinking relationship with the piston 4B, so as to open a piping 22A through a silencer 25, thereby reducing the power during no-load operation.

It is necessary to control the temperature of the air released from the silencer 25 during the no-load operation to 100° C. or thereabout in order to ensure the durability of the air release valve 23 and to prevent the internal temperatures of a sound insulation cover 21 from rising.

For this reason, it is necessary for the piping 22A, through which air is released, to be disposed downstream of the precooler 5 and upstream of the check valve 7 so as to maintain the user-side line pressure during no-load operation.

If the capacity of the precooler 5 is designed in such manner that the temperature of the check valve 7 becomes 150° C. or thereabout during loaded operation, the amount of air flowing in decreases substantially during no-load operation. Therefore, it is possible to set the temperature of air released through the air release valve 23 to about 100° C.

In accordance with the above-described method, the precooler 5 can be made to perform the function of a gas release cooler provided in U.S. Pat. No. 4,529,363.

As shown most clearly in FIGS. 4*a* to 4*d*, the precooler 5 includes an inlet portion 5A, an inlet portion header 5B, a plurality of cooling pipes 5C, an outlet portion header 5D, an outlet portion 5E, and a support 5F. The inlet portion 5A of the precooler 5 is connected to a discharge port 1B of the compressor body 1. Each of the cooling pipes 5C has a substantially U-shaped configuration and is supported by but not secured to the support 5F. Inlet ends and outlet ends of each of the cooling pipes 5C are respectively secured to the inlet portion header 5B and the outlet portion 5D. A top portion of the cooling pipes 5C is not fixed and, consequently, the respective cooling pipes 5C may be elongated so that the top portion is not subjected to excessive thermal stress with respect to thermal expansion of the cooling pipes 5C due to high temperatures. Since the temperature of the compressed air introduced into the precooler 5 is about 350° C. and the pressure is about 7 kg/cm$^2$g, the inlet portion header 5B and the cooling pipes 5C are formed of stainless steel or other similar material.

As shown in FIG. 2, an automatic valve 16 is provided which simultaneously opens when the compressor is stopped. The automatic valve 16 is disposed at a lowermost position of the piping 5*g* extending between the discharge port 1*b* of the compressor body 1 and the inlet portion 5A of the precooler 5. The opening of the automatic valve 16 is provided so as to compensate for a malfunctioning of the check valve 7.

The automatic valve 16 may, for example, be a conventional electromagnetic valve which opens upon a receipt of a stop signal from a starter of the compressor. By virtue of the provision of the automatic valve 16, there is no danger of any drainage from a user line flowing into the rotor casing of the compressor which would ultimately lead to a corrosion of the compressor and a possible malfunctioning thereof.

The after cooling cooler 6 is connected to the outlet portion 5E of the precooler 5, and its outlet is arranged to be connected to the user-side piping. The after cooler 6 should preferably be formed of aluminum or other similar material which excels in the heat exchange performance. For that reason, it is necessary for the temperature of the compressed air at the outlet portion 5E of the precooler 5 to be 150° C. or thereabout. As for the check valve 7, it is necessary to maintain its temperature below 250° C. to maintain its durability and above 100° C. at which drain is not produced. The check valve 7 is disposed between the precooler 5 and the after cooler 6 to prevent the backward flow of air from the after cooler 6 during the no-load operation of the compressor. The oil cooler 8 is connected, at an inlet thereof, to an outlet of the oil pump 12 through a piping 16A and is also connected, at an outlet thereof, to a lubricated portion, for example, the timing gear 1G and a bearing, of the compressor body 1 through a piping 16B. Oil, after being discharged from the lubricated portion of the compressor 1, returns to an oil tank 11A of the transmission mechanism 11. The cooling fan 10 includes a fan casing 10A and an impeller 10B coupled to a motor 17. The transmission mechanism 11 includes a gear casing 11B having an oil tank 11A, a pinion gear 11C coupled to the male rotor 1E and a driving gear 11D engaged with the pinion gear 11C. The oil pump 12 is connected to a shaft 11E of the driving gear 11D through a gear, and communicates with the oil tank 11A through a pipe at an inlet thereof.

The coolant cooler 13 is connected at an outlet thereof to the jacket 1C through a piping 19A, a coolant pump 14 and a piping 19B, and is also connected at an inlet thereof to the jacket 1C through a piping 19C. The coolant pump 14 is driven by a motor 18 and an intake of the cooling fan 10 is connected to a cooler intake port 21E of the sound insulation cover 21, and a discharge thereof is connected to the air inlet ports of the coolant cooler 13, the oil cooler 8 and the after cooler 6, so that air is supplied from the cooling fan 10 to the coolant cooler 13, the oil cooler 8 and the after cooler 6.

The heat conductive pipe 22A branching off from the outlet of the precooler 5 is connected to an air release valve 23 through a piping 24A, and this release valve 23 is connected to the silencer 25 through a piping 25B.

The above-described components are enclosed by the sound insulation cover 21 provided with an air intake 21A for compression, an air intake 21B for cooling the main motor 2, an air intake 21C for ventilation, an air outlet 21D and an air intake 21E for the cooler.

A coolant, mainly composed of propylene glycol and containing a metal corrosion inhibitor for copper, aluminum, or iron, or an aqueous solution of substances containing water in the amount of 50–70% volume is charged in the coolant cooler 13, the jacket 1C, the coolant pump 14 and the pipings 19A, 19B, 19C. At least the density or flowing ratio of propylene glycol is preferably 30% to prevent the system from corrosion.

In operation, the rotational force of the main motor 2 is transmitted to a shaft 11E by the V-belt 3, and, after the rotating speed is increased by a pinion gear 11C and a drive gear 11D, the rotational force is transmitted to the male rotor 1E and further to the female rotor 1F by the timing gear 1G.

The compressed air, whose temperature is raised to a temperature of about 300°-350° C. by being compressed in the compressor body 1, passes through a piping 5G and a first air cooler, i.e., the precooler 5, where the compressed air is primarilarly cooled to 150° C. or thereabout by the cooling air from the cooling fan 10. Subsequently, the compressed air passes through the check valve 7 and then enters a second air cooler, i.e., the after cooler 6, where the compressed air is secondarily cooled to about 50° C. by the cooling air from the cooling fan 10 and is discharged to the user side.

The coolant in the jacket 1C absorbs the heat generated by compression of air in the compressor body 1, enters the coolant cooler 13 through a piping 19C to be cooled by the cooling air from the cooling fan 10, and returns to the jacket 1C through a piping 19A, the coolant pump 14 and a piping 19B.

Lubricating oil is contained in an oil tank 11A inside the transmission mechanism 11, is delivered by the oil pump 12, supplied to the oil cooler 8 through a piping 16A where it is cooled by the cooling air from the cooling fan 10, and supplied to the timing gear 1G inside the compressor body 1 through a piping 16B. After lubricating the timing gear 1G, oil is recovered by an oil tank 11A inside a gear casing 11B and is recirculated.

Figure 3:
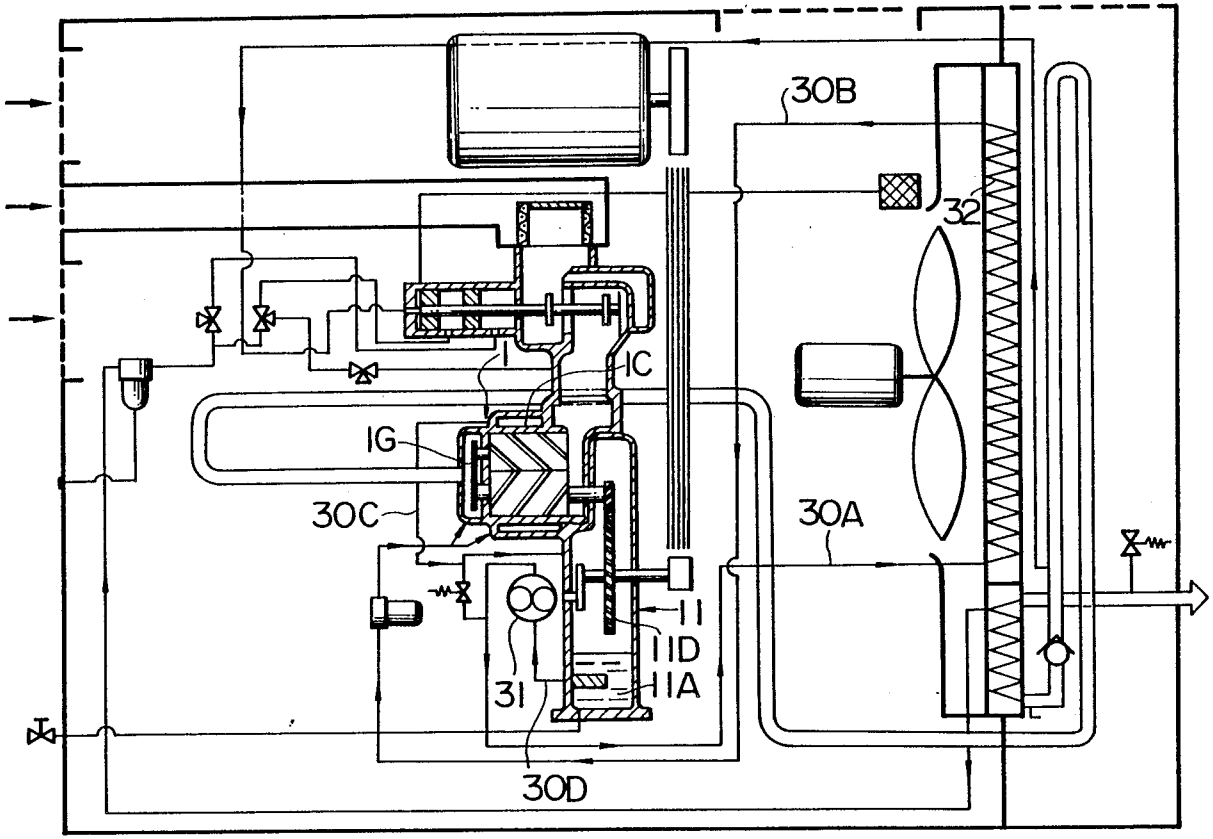
FIG. 3 is a schematic diagram of the air-cooled oil-free rotary-type compressor in accordance with the second embodiment.
Figure 4A:
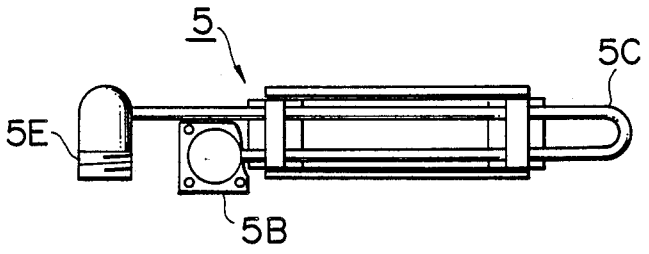
FIGS. 4*a* is a top view of a precooler for a rotary type compressor in accordance with the present invention.
Figure 4B:
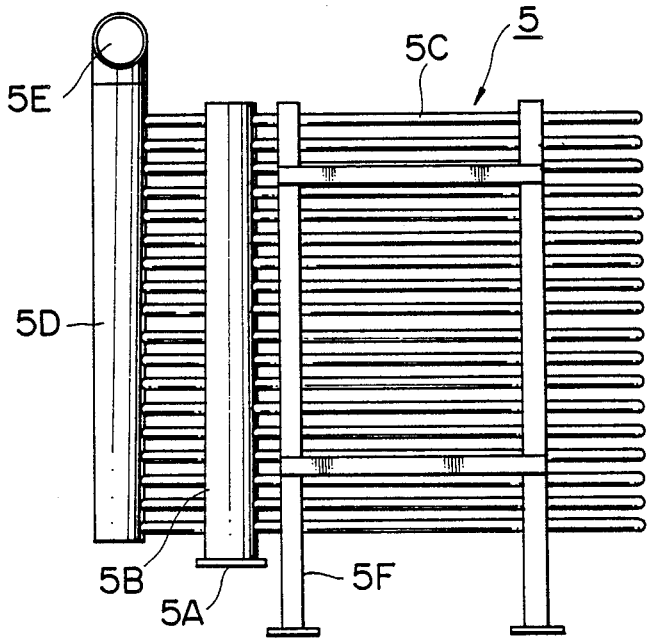
FIG. 4*b* is a plan view of the precooler of FIG. 4*a*.
Figure 4C:
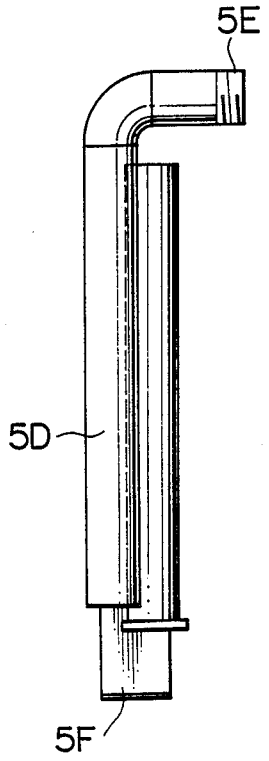
FIG. 4*c* is a first side view of the precooler of FIG. 4*a*.
Figure 4D:
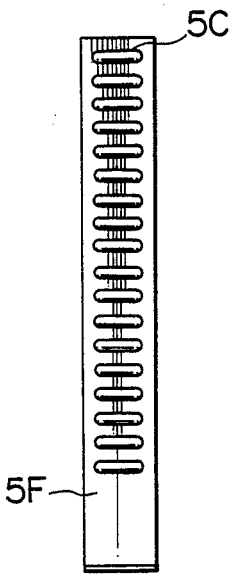
FIG. 4*d* is a second side view of the precooler of FIG. 4*a*.

Referring to FIG. 3, which illustrates the air-cooled oil-free rotary-type compressor in accordance with a second embodiment, this compressor differs from the air-cooled oil-free rotary-type compressor in accordance with the first embodiment in that the compressor of FIG. 5 employs lubricating oil as the coolant circulating through the jacket 1C of the compressor body 1. In the second embodiment shown in FIG. 3, an oil cooler 32 is connected, at an inlet thereof, to the outlet of an oil pump 31 through a pipe 30B, and is also connected, at an outlet thereof, to the jacket 1C, a lubricated portion, e.g., the timing gear 1G, of the compressor body 1 and the bearing. Oil, after being discharged from the jacket 1C and the lubricated portion of the compressor body 1 returns to the oil tank 11A of the transmission mechanism 11. The oil pump 31 is connected to the shaft of the drive gear 11D through a gear, and communicates at an inlet thereof with the oil tank 11A through a pipe 30D.

In the embodiment of FIG. 3, the coolant cooler 13, the piping 19A, the coolant pump 14 and the pipings 19B, 19C, used in the first embodiment are not required. However, the capacity of the oil pump 31 and the oil cooler 32 is greater than that of the oil pump 12 and the cooler 8 in the first embodiment. In accordance with the embodiment of FIG. 3, it is possible to expect an effect similar to that one obtained in the first embodiment. In addition, since the number of components used can be reduced and the piping system can be simplified, it is possible to produce an apparatus of a compact size and attain a reduction in the product price.

Although description has been given of a case where the present invention is applied to an oil-free screw compressor, the present invention is not restricted to the same and is applicable to other types of air-cooled oil-free rotary-type compressor, and a similar effect can be expected.

What is claimed is:

1. An air-cooled oil-free rotary-type compressor comprising:

a first air cooling-type air cooler means including a plurality of cooling pipes; back flow preventing means; and a second air cooling-type air cooler means, wherein said first air cooling-type air cooler means, said back-flow preventing means and said second air cooling-type air cooler means are disposed in a channel of a discharge gas compressed in a compressor body.

2. An air-cooled oil-free rotary-type compressor according to claim 1, wherein said back-flow preventing means is disposed between an outlet of said first air cooling-type air cooler means and an inlet of said second air cooling-type air cooler means.

3. An air-cooled oil-free rotary-type compressor according to claim 2, further comprising an automatic valve means disposed at a lowermost position of a passage extending between a discharge port of said compressor body and the inlet of said first air cooling-type air cooler means, said automatic valve means being adapted to be opened while said compressor is stopped so as to compensate for a malfunctioning of said back-flow preventing means.

4. An air-cooled oil-free rotary-type compressor according to claim 1, wherein at least a part of said first air cooling-type air cooler means is located downstream of an airflow for cooling said second air cooling-type air cooler means.

5. An air-cooled oil-free rotary-type compressor according to one of claims 1, 2 or 4, wherein said first air cooling-type air cooler means includes a heat exchanger means connected to a discharge port of said compressor body for primarily cooling high-temperature air discharged from the compressor body, said heat exchanger means having an inlet portion header and an outlet portion header, said plurality of cooling pipes having a substantially U-shaped configuration and connecting said inlet portion header and said outlet portion header, an end portion of each of said substantially U-shaped cooling pipes is respectively secured to said inlet portion header and said outlet portion header, and wherein an air flow inlet for said inlet portion header is disposed at a position 180° in opposition to an air flow outlet of said outlet portion header in an axial direction of said inlet portion header and said outlet portion header.

6. An air-cooled oil-free rotary-type compressor comprising;

a cooling means;

a first air cooling-type air cooler means including a plurality of cooling pipes; back-flow preventing means; and a second air cooling-type air cooler means, wherein said first air cooling-type air cooler means, said back-flow preventing means and said second air cooling-type air cooler means are respectively disposed in a channel of a discharge gas compressed in a compressor body and are arranged in a passage of an air flow passing through said cooling fan means.

7. An air-cooled oil-free rotary-type compressor according to claim 6, wherein said back-flow preventing means is disposed between an outlet of said first air cooling-type air cooler means and an inlet of said second air cooling-type air cooler means.

8. An air-cooled oil-free rotary-type compressor according to claim 7, further comprising an automatic valve means disposed at a lowermost position of a passage extending between a discharge port of said compressor body and the inlet of said first air cooling-type air cooler means, said automatic valve means being adapted to be opened while said compressor is stopped so as to compensate for a malfunctioning of said back-flow preventing means.

9. An air-cooled oil-free rotary-type compressor according to claim 6, wherein at least a part of said first air cooling-type air cooler means is located downstream of an air flow for cooling said second air cooling-type air cooler means.

10. An air-cooled oil-free rotary-type compressor according to one of claims 6, 7, or 9, wherein said first air cooling-type air cooler means includes a heat exchanger means connected to a discharge port of said compressor body for primarily cooling high-temperature air discharged from the compressor body, said heat exchanger means having an inlet portion header and an outlet portion header, said plurality of cooling pipes having a substantially U-shaped configuration and connecting said inlet portion header and said outlet portion header, an end portion of each of said substantially U-shaped cooling pipes being respectively secured to said inlet portion header and said outlet portion header, and wherein an air flow inlet for said inlet portion header is disposed at a position 180° in opposition to an air flow outlet from said outlet portion header in an axial direction of said inlet portion header and said outlet portion header.

11. An air-cooled oil-free rotary-type compressor comprising;

a coolant means for cooling a coolant subjected to heat exchange in a jacket means of a compressor body; an oil cooler means for cooling a lubricating oil subjected to heat exchange in a lubricated portion of said compressor; a cooling fan means; a first air cooling-type air cooler means; a back-flow preventing valve means; and a second air cooling-type air cooler means, wherein said first air cooling-type air cooler means, said back-flow preventing valve means and said second air cooling-type air cooler means are disposed in a passage of a discharge gas compressed inside said compressor body, and at least said coolant cooler means, said oil cooler means, said first air cooling-type air cooler means and said second air cooling-type air cooler are disposed in a passage of an air flow passing through said cooling fan means.

12. An air-cooled oil-free rotary-type compressor according to claim 11, wherein said back-flow preventing valve means is disposed between an outlet of said first air-cooling type air cooler means and an inlet of said second air cooling-type air cooler means.

13. An air-cooled oil-free rotary-type compressor according to claim 12, further comprising an automatic valve means disposed at a lowermost position of a passage extending between a discharge port of said compressor body and the inlet of said first air cooling-type air cooler means, said automatic valve means being adapted to be opened while said compressor is stopped so as to compensate for a malfunctioning of said back-flow preventing valves means.

14. An air-cooled oil-free rotary-type compressor according to claim 11, wherein said first air cooling-type air cooler means is located downstream of said coolant cooler means, said oil cooler means and said second air cooling-type air cooler means in the passage of said air flow passing through said cooling fan means.

15. An air-cooled oil-free rotary-type compressor according to one of claims 11, 12 or 14, wherein said first air cooling-type air cooler means includes a heat exchanger means connected to a discharge port of said compressor body for primarily cooling high-temperature air discharged from the compressor body, said heat exchanger means having an inlet portion header, an outlet portion header and a plurality of substantially U-shaped cooling pipes, said plurality of cooling pipes connecting said inlet portion header and said outlet portion header, an end portion of each of said substantially U-shaped cooling pipes being respectively secured to said inlet portion header and said outlet portion header, and wherein an air flow inlet force said inlet portion header is disposed at a position 180° in opposition to an air flow outlet from said outlet portion header in an axial direction of said headers.

16. An air-cooled oil-free rotary-type compressor comprising;

an oil cooler means for cooling oil subject to heat exchange in said compressor; a cooling fan means; a first air cooling-type air cooler means; a backflow preventing means; and a second air cooling-type air cooler means, wherein said first air cooling-type air cooler means, said back-flow preventing means and said second air cooling-type air cooler means are disposed in a channel of a discharge gas compressed in a compressor body, and wherein at least said oil cooler means, said first air cooling-type air cooler means and said second air cooling-type air cooler means are disposed in a passage of an air flow passing through said cooling fan means.

17. An air-cooled oil-free rotary-type compressor according to claim 16, wherein said oil cooler means is adapted to cool oil subjected to heat exchange in a jacket of the compressor and a lubricated portion of said compressor.

18. An air-cooled oil-free rotary-type compressor according to claim 16, wherein said backflow preventing means is disposed between an outlet of said first air cooling-type air cooler means and an outlet of said second air cooling-type air cooler means.

19. An air-cooled oil-free rotary-type compressor according to claim 18 further comprising:

an automatic valve means disposed at a lowermost position of a passage extending between a discharge port of said compressor body and the inlet of said first air-cooling type air cooler means, said automatic valve means being adapted to be opened while said compressor is stopped so as to compensate for a malfunctioning of said back-flow preventing means.

20. An air-cooled oil-free rotary-type compressor according to claim 16, wherein said first air cooling type air cooler means is located downstream of said oil cooler means and said second air cooling-type air cooler means in the passage of said air flow through said cooling fan means.

21. An air-cooled oil-free rotary-type compressor according to one of claims 16, 17, 18 or 20, wherein said first air-cooling type air cooler means includes a heat exchanger means connected to a discharge port of said compressor body for primarily cooling high-temperature air discharged from the compressor body, said heat exchanger means having an inlet portion header, and outlet portion header and a plurality of substantially U-shaped cooling pipes, said plurality of cooling pipes connecting said inlet portion header and said outlet portion header, an end portion of each of said substantially U-shaped cooling pipes being respectively secured to said inlet portion header and said outlet portion header, and wherein an axial flow inlet force and inlet portion header is disposed at a position 180° in opposition to an air flow outlet from said outlet portion header in an axial direction of said inlet portion header and said outlet portion header.

* * * * *